US009862205B2

(12) United States Patent
Obara

(10) Patent No.: US 9,862,205 B2
(45) Date of Patent: Jan. 9, 2018

(54) PRINTER

(71) Applicant: SATO HOLDINGS KABUSHIKI KAISHA, Tokyo (JP)

(72) Inventor: Takeshi Obara, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/310,273

(22) PCT Filed: Apr. 8, 2015

(86) PCT No.: PCT/JP2015/060944
§ 371 (c)(1),
(2) Date: Nov. 10, 2016

(87) PCT Pub. No.: WO2016/006291
PCT Pub. Date: Jan. 14, 2016

(65) Prior Publication Data

US 2017/0266996 A1 Sep. 21, 2017

(30) Foreign Application Priority Data

Jul. 10, 2014 (JP) ..... 2014-142097

(51) Int. Cl.

| | |
|---|---|
| ***B41J 2/32*** | (2006.01) |
| ***B41J 3/36*** | (2006.01) |
| ***B41J 3/407*** | (2006.01) |
| ***B41J 11/00*** | (2006.01) |
| ***B41J 15/04*** | (2006.01) |
| ***B41J 29/02*** | (2006.01) |

(Continued)

(52) U.S. Cl.
CPC ..... *B41J 3/4075* (2013.01); *B41J 2/32* (2013.01); *B41J 3/36* (2013.01); *B41J 11/0045* (2013.01); *B41J 11/04* (2013.01); *B41J 15/04* (2013.01); *B41J 29/02* (2013.01); *B41J 29/13* (2013.01)

(58) Field of Classification Search
CPC ..... B41J 2/32; B41J 3/36; B41J 3/4075; B41J 11/0045; B41J 15/04; B41J 29/02
See application file for complete search history.

(56) References Cited

U.S. PATENT DOCUMENTS

| | | | | |
|---|---|---|---|---|
| 7,033,097 | B2 * | 4/2006 | Petteruti | B41J 3/36 400/691 |
| 7,241,063 | B2 * | 7/2007 | Sago | B41J 11/0015 271/278 |
| 2006/0008312 | A1 | 1/2006 | Sago et al. | |

FOREIGN PATENT DOCUMENTS

| | | | |
|---|---|---|---|
| JP | 09-254473 | A | 9/1997 |
| JP | 2004-188935 | A | 7/2004 |

(Continued)

*Primary Examiner* — Kristal Feggins
*Assistant Examiner* — Kendrick Liu
(74) *Attorney, Agent, or Firm* — Foley & Lardner LLP

(57) ABSTRACT

The ridge part T projecting from an interior surface of an opening and closing cover 3 of a printer 1 is provided at part of a head 3*b* that make contact with a mountless label continuous body P including an adhesive agent layer on one surface thereof. The head 3*b* is located at a free end of the opening and closing cover 3. A third ridge part T3 is provided on a third surface S3, which is located in vicinity of an intersecting line between a first surface S1 and a second surface S2. The third ridge T3 has a longer projecting length than a ridge part T1 projecting from the first surface S1, and has a longer projecting length than a ridge part T2 projecting from the second surface S2.

5 Claims, 11 Drawing Sheets

(51) Int. Cl.
*B41J 11/04* (2006.01)
*B41J 29/13* (2006.01)

(56) References Cited

FOREIGN PATENT DOCUMENTS

| | | | |
|---|---|---|---|
| JP | 2006-026931 | A | 2/2006 |
| JP | 2008-062597 | A | 3/2008 |
| JP | 2012-240202 | A | 12/2012 |
| JP | 2016-016620 | A | 2/2016 |

* cited by examiner

PRINTER

TECHNICAL FIELD

The present invention relates to a printer, for instance, a label printer configured to print desired information such as a character, a sign, a diagram, a bar code or so forth on a label continuous body.

BACKGROUND

A label printer is a type of printer exclusively for label printing. For example, the label printer is configured to rotate a platen roller while a label continuous body wound in a roll shape is pinched at one end thereof between the platen roller and a thermal head, whereby feeding of the label continuous body is performed. During feeding of the label continuous body, the label printer is configured to print desired information on one or more labels of the label continuous body.

For example, Japan Laid-open Patent Application Publication No. 2008-62597 discloses a label printer including a separator configured to separate each of labels from a label continuous body. A printer body of the label printer is provided with an opening and closing cover configured to open and close a supply part for supplying the label continuous body. A platen roller is rotatably supported by the tip of the opening and closing cover. A thermal head is mounted to the interior of the printer body, and is configured to face the platen roller when the opening and closing cover is set in a closed state. In a print processing, part of the label continuous body, released from the supply part built in the printer body, is fed while being pinched between the platen roller and the thermal head. During feeding of the label continuous body, the thermal head is configured to print desired information on each of the labels of the label continuous body.

SUMMARY OF THE INVENTION

Technical Problem

Incidentally, there is a type of label continuous body called "mountless labels". The mountless labels are a strip of continuous labels without a mount and include an adhesive agent layer on one surface thereof and a release agent layer on the other surface thereof. When the mountless labels are used in a label printer designed to use a label continuous body, a part of a printer body of the label printer, making contact with the adhesive agent of the label continuous body, is made of non-adhesive material or is processed with non-adhesive treatment, whereby the adhesive agent of the label continuous body is prevented from easily sticking to the part.

However, in a feeding path provided in the interior of the printer body to feed the label continuous body, the adhesive agent of the label continuous body sticks in a laminated manner to a part configured to frequently make contact with the adhesive surface of the label continuous body. Hence, even if the part is processed with non-adhesive treatment, the adhesive surface of the label continuous body becomes likely to stick to the part. Consequently, this results in a drawback of incapability of smoothly feeding the label continuous body.

The present invention has been conceived in view of the aforementioned technical background, and is intended to provide a technology whereby performance of feeding a print medium can be enhanced in a printer.

Solution to Problem

A printer according to a first aspect of the present invention includes a housing, a print medium container, an opening and closing cover, a feed roller and a print head. The housing is provided with an opening. The print medium container is built in the opening of the housing and is capable of containing a print medium including an adhesive agent layer on one surface thereof. The opening and closing cover is attached to the housing and is configured to open and close the print medium container. The feed roller is configured to feed the print medium. The print head is mounted opposing the feed roller and is configured to perform printing on the print medium. The printer is characterized in that the opening and closing cover is provided with a head on a free end thereof, and the head gradually reduces in thickness toward a tip thereof and includes a ridge part projecting from an end thereof.

A printer according to a second aspect of the present invention is characterized as follows. The head includes a first surface and a second surface. The first surface is configured to face the print medium container when the opening and closing cover is set in a closed state. The second surface is configured to face the adhesive agent layer of the print medium when the print medium is fed from the print medium container toward the feed roller. The end of the head is located in vicinity of an intersecting line between the first surface and a second surface. The second surface is provided with a ridge part projecting therefrom. The ridge part projecting from the end of the head has a longer projecting length than the ridge part projecting from the second surface whereby the print medium is supported by the feed roller and the ridge part projecting from the end of the head when the print medium makes contact with the ridge part projecting from the end.

In a printer according to a third aspect of the present invention, the first surface of the opening and closing cover may be provided with a ridge part having a shorter projecting length than the ridge part projecting from the end of the head.

In a printer according to a fourth aspect of the present invention, the second surface may be provided with a sensor configured to detect the print medium.

Advantageous Effects

According to the present invention, a contact area can be reduced between the adhesive agent layer of the print medium and a member located in a feeding path for the print medium. Hence, performance of feeding the print medium can be enhanced in the printer.

Additionally, a contact area can be reduced between the first surface and the print medium inside the paper container. Hence, it is possible to reduce frictional resistance occurring in rotation of the print medium inside the paper container.

Moreover, a gap enough to detect the print medium can be reliably produced between the print medium and the sensor. Hence, the print medium can be successfully detected by the sensor.

DESCRIPTION OF EMBODIMENTS

Figure 1A:
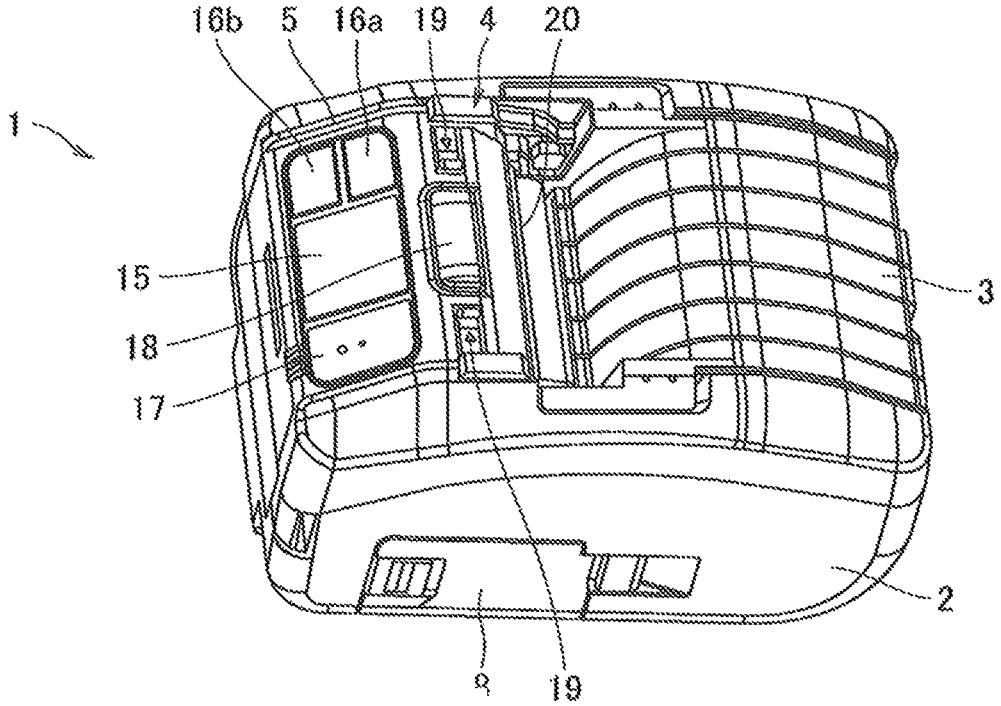
FIG. 1A is an entire perspective view of a printer according to an exemplary embodiment of the present invention in a normal ejection mode.

This application claims priority to Japanese Patent Application No. 2014-142097 filed on Jul. 10, 2014, the entirety of which is hereby incorporated by reference in its entirety.

Based on drawings, an exemplary embodiment will be hereinafter explained in detail as an example of the present invention. It should be noted that in principle, the same constituent elements will be denoted by the same reference sign in the drawings for explaining the exemplary embodiment, and will not be explained repeatedly.

In the present invention, the term "print feeding direction" refers to a direction in which a label continuous body (exemplary print medium) is fed for a printing purpose, specifically, a direction that the label continuous body is fed from a paper supplying part to a thermal head. The term "back feeding" refers to a motion to feed the label continuous body reversely to the print feeding direction after printing of desired information on a given label of the label continuous body whereby the other labels are reversely shifted such that the label next to the given label is returned to a print starting position.

The terms "normal ejection" and "separation ejection" are defined on the premise that "labels with a mount", composed of a long strip of mount and a plurality of continuous labels temporarily attached to the mount at predetermined intervals, are used in a printer as a label continuous body. The term "normal ejection" refers to an ejection mode configured to eject the labels from the printer while the labels are attached to the mount without being separated therefrom. On the other hand, the term "separation ejection" refers to an ejection mode configured to eject the labels from the printer while the labels are separated from the mount one by one. The normal ejection is applied in printing some types of label continuous body such as the aforementioned mountless labels or a continuous sheet without any adhesive agent layer.

Figure 1B:
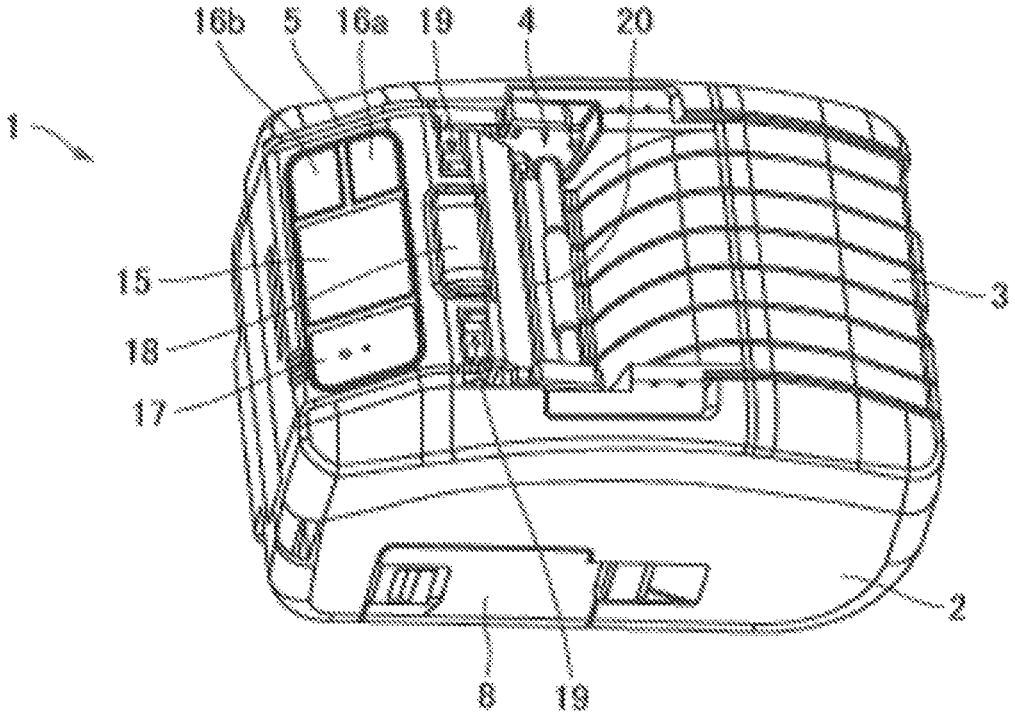
FIG. 1B is an entire perspective view of the printer shown in FIG. 1A in a separation ejection mode.
Figure 2:
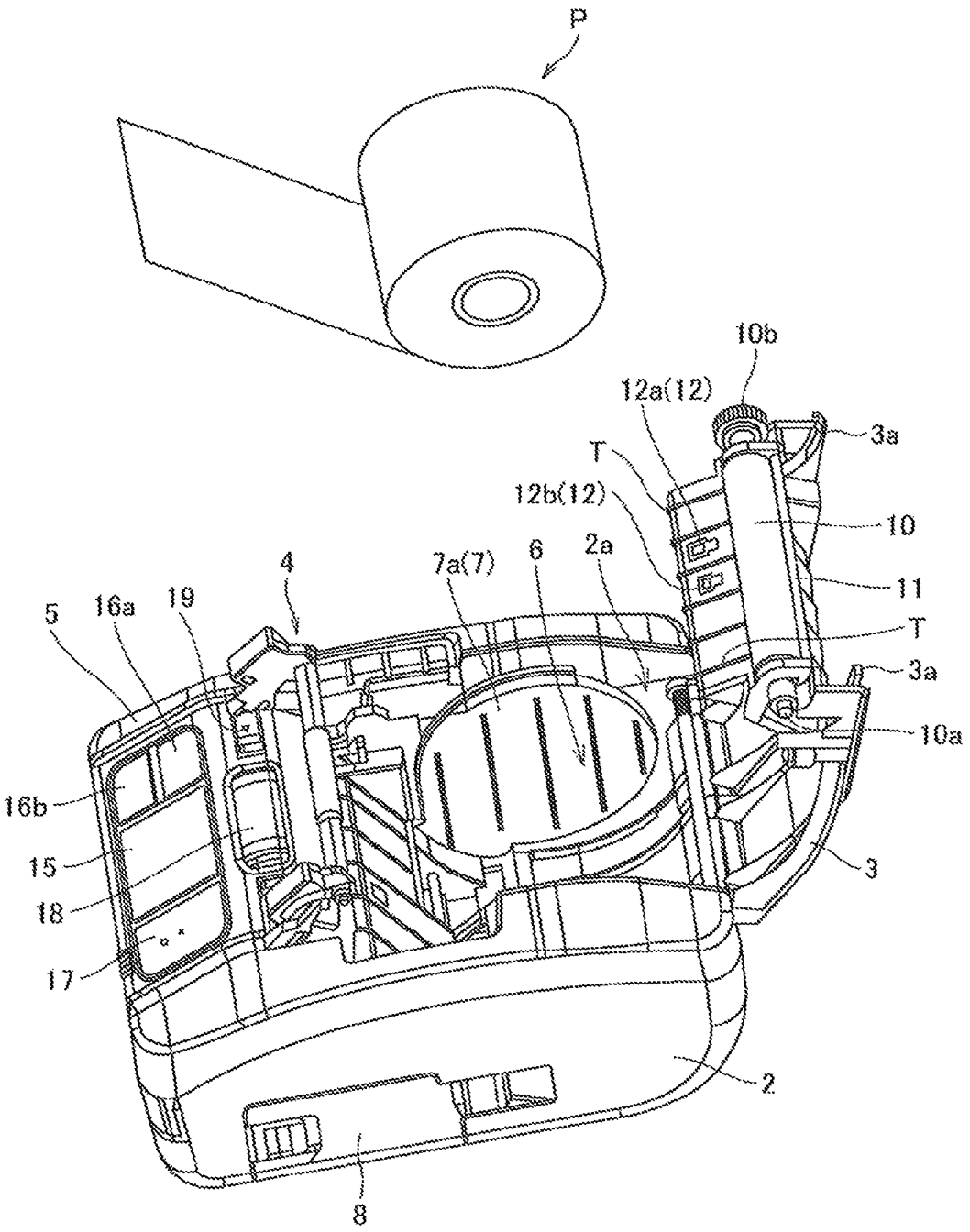
FIG. 2 is an entire perspective view of the appearance of a label continuous body and the printer shown in FIG. 1A when an opening and closing cover is set in an opened state.
Figure 3:
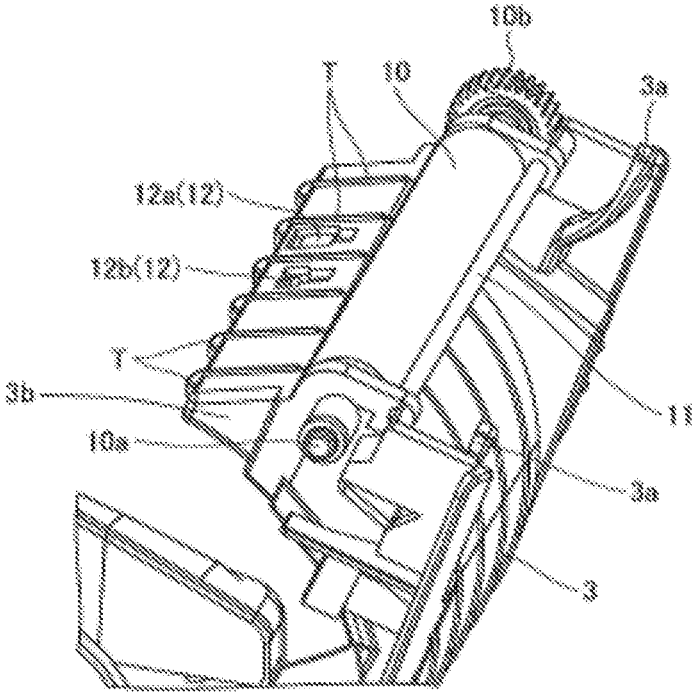
FIG. 3 is a perspective view of major elements of the opening and closing cover of the printer shown in FIG. 1A.
Figure 4A:
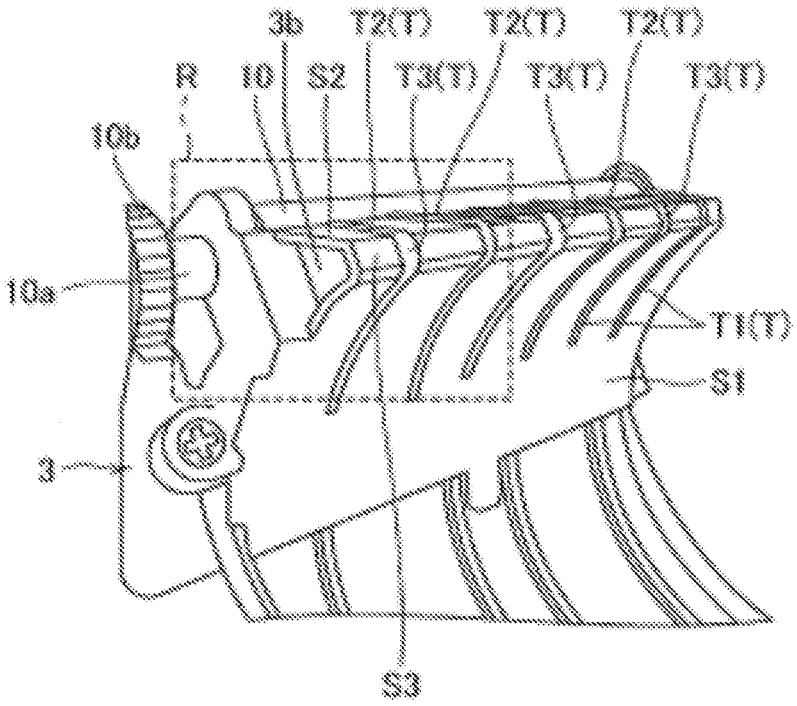
FIG. 4A is a perspective view of the major elements of the opening and closing cover shown in FIG. 3 and is seen from the opposite side of the view of the opening and closing cover shown in FIG. 3.
Figure 4B:
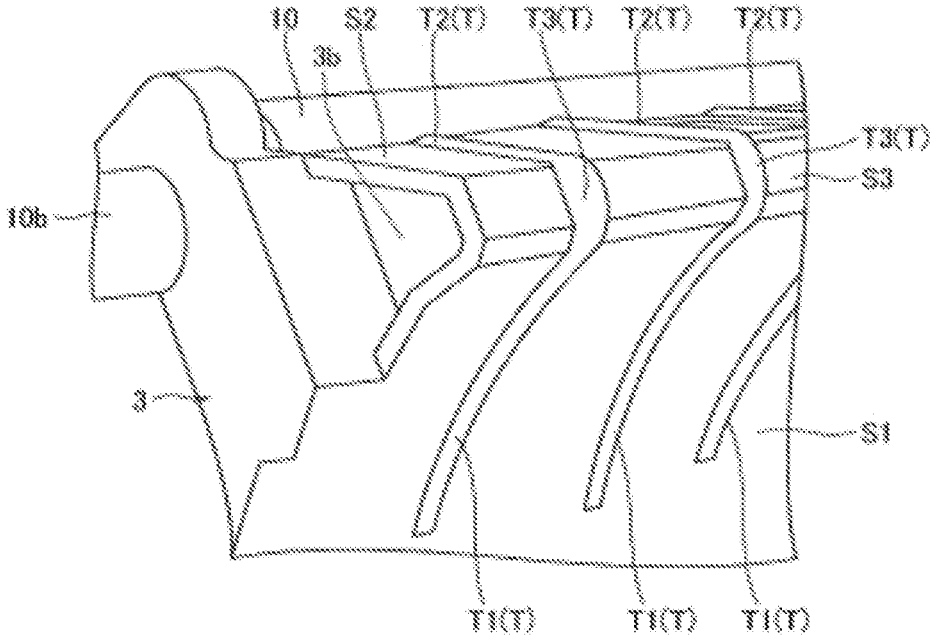
FIG. 4B is an enlarged perspective view of a region R enclosed by broken line in FIG. 4A.
Figure 5:
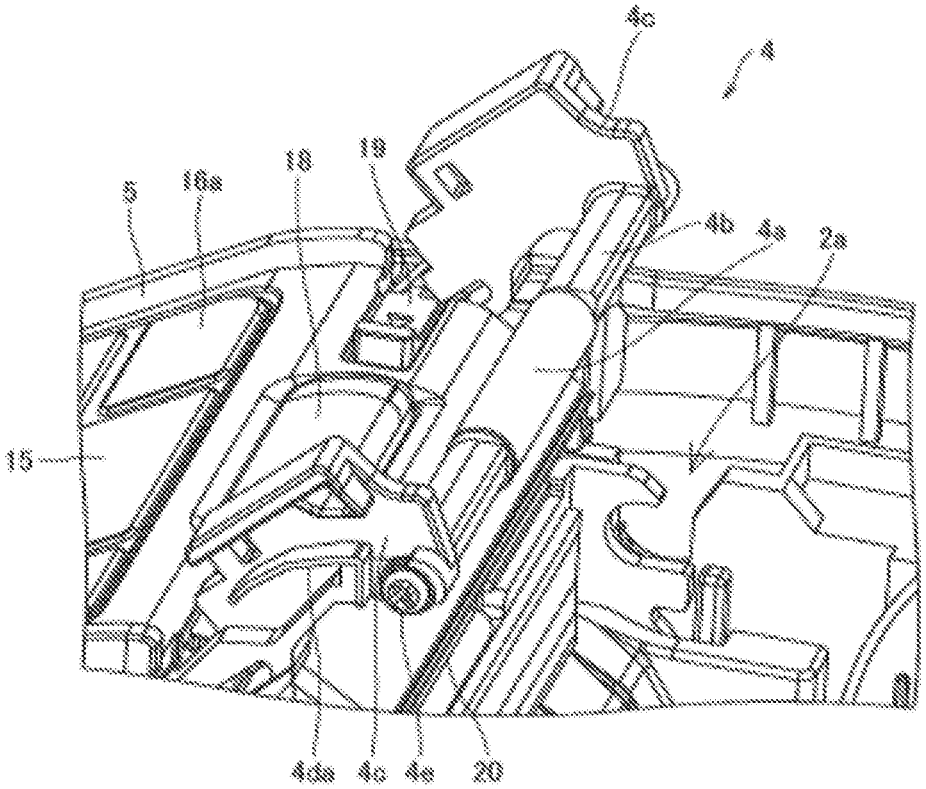
FIG. 5 is an enlarged perspective view of major elements of a separation unit and its surroundings in the printer shown in FIG. 2.

FIG. 1A is an entire perspective view of a printer according to the present exemplary embodiment in a normal ejection mode. FIG. 1B is an entire perspective view of the printer shown in FIG. 1A in a separation ejection mode. FIG. 2 is an entire perspective view of the appearance of a label continuous body and the printer shown in FIG. 1A when an opening and closing cover is set in an opened state. FIG. 3 is a perspective view of major elements of the opening and closing cover of the printer shown in FIG. 1A. FIG. 4A is a perspective view of the major elements of the opening and closing cover shown in FIG. 3 and is seen from the opposite side of the view of the opening and closing cover shown in FIG. 3 (from the same side as a gear 101*b* to be described). FIG. 4B is an enlarged perspective view of a region R enclosed by broken line in FIG. 4A. FIG. 5 is an enlarged perspective view of major elements of the separation unit and its surroundings in the printer shown in FIG. 2.

As shown in FIG. 1A, a printer 1 according to the present exemplary embodiment is a portable label printer made in a flat cuboid shape, for instance, and includes a body case 2 (housing), an opening and closing cover 3, a separation unit 4 (separation mechanism) and a front cover 5. The printer 1 is of a dual mode type configured to be capable of switching between normal ejection and separation ejection by itself. It should be noted that the printer 1 is not only usable with an ejection port facing upwards (in horizontal installation), but also usable with the ejection port facing sideward (in a vertical installation) by hooking a belt hook (not shown in the drawings) mounted to the bottom surface of the printer 1 on a belt of a worker or by attaching a shoulder belt (not shown in the drawings) to the printer 1 and then hanging the shoulder belt on the shoulder of the worker.

The body case 2 is a housing that composes part of the contour of the printer 1, and as shown in FIG. 2, includes an opening 2*a* in one surface thereof. A paper container 6 (print medium container) is built in the opening 2*a*. The paper container 6 is a region for accommodating a label continuous body P wound in a roll shape. A pair of guide plates 7*a* of a paper guide mechanism 7 is installed in the interior of the paper container 6. The paper guide mechanism 7 is a mechanism for supporting and guiding the label continuous body P in accordance with its width. It should be noted that as shown in FIGS. 1A and 2, a battery cover 8 is pivotably supported by one of the lateral surfaces of the body case 2, and can take an opened or closed position. The battery cover 8 is an opening and closing cover for a battery container to be described (not shown in FIGS. 1A to 5).

As shown in FIG. 2, the label continuous body P is, for instance, a strip of continuous labels (mountless labels) including an adhesive agent layer on one surface thereof. The label continuous body P is wound in a roll shape and is accommodated in the paper container 6. In order to indicate the locations of the labels, location detection marks (not shown in the drawings) are provided on the adhesive agent layer side of the label continuous body P while being aligned along the lengthwise direction of the label continuous body P at predetermined intervals. Additionally, a thermosensitive color developing layer is disposed on the front surface (located on the back side of the surface on which the adhesive agent layer is disposed, and is also referred to as a printing surface) of the label continuous body P. The thermosensitive color developing layer is configured to turn a predetermined color (black, red, etc.) when reaching a predetermined temperature range.

The opening and closing cover 3 is an opening and closing cover for closing and opening the paper container 6. One lengthwise end of the opening and closing cover 3 (lengthwise middle of the body case 2) is movable in directions separating from and approaching to the body case 2, while the other lengthwise end thereof is pivotably supported by one lengthwise end of the body case 2 through a hinge or so forth. Additionally, the opening and closing cover 3 is urged in an opening direction (a separating direction of the one lengthwise end of the opening and closing cover 3 from the body case 2) by a torsion spring (not shown in FIGS. 1A to 3) disposed on the other lengthwise end thereof.

As shown in FIGS. 2 and 3, the one lengthwise end of the opening and closing cover 3 is provided with a pair of unit holding portions 3*a*. The pair of unit holding portions 3*a* is a pair of portions configured to press and fix the separation unit 4 in a separation ejection position when the opening and closing cover 3 is set in a closed state in performing separation ejection. The pair of unit holding portions 3*a* is provided on the both ends of the opening and closing cover 3 in the width direction (a direction perpendicular to the lengthwise direction of the opening and closing cover 3).

As shown in FIGS. 2 to 4B, a platen roller 10 (exemplary feed roller) is rotatably supported by the one lengthwise end of the opening and closing cover 3 so as to be rotatable in normal and reverse directions. The platen roller 10 is feeding means for feeding the label continuous body P. The platen roller 10 is mounted while extending along the width direction of the label continuous body P. The platen roller 10 is made of, for instance, non-adhesive material such as silicone-contained resin or silicone rubber in order to prevent the adhesive agent of the label continuous body P from sticking thereto.

A gear 10*b* is connected to one end of a platen roller shaft 10*a* of the platen roller 10. When the opening and closing cover 3 is set in the closed state, the gear 10*b* is configured to be engaged with a gear and so forth (not shown in the drawings) mounted in the opening 2*a*, and be mechanically connected to a stepping motor for roller driving (not shown in the drawings) and so forth through the gear and so forth.

As shown in FIGS. 2 and 3, a separation pin 11 is mounted to the one lengthwise end of the opening and closing cover 3 along and in the vicinity of the platen roller 10. The separation pin 11 is a separation member is supported at the both lengthwise ends thereof by the opening and closing cover 3. When labels with a mount are used as a label continuous body, the separation pin 11 is configured to separate the labels from the mount.

As shown in FIGS. 3, 4A and 4B, the opening and closing cover 3 is provided with a head 3*b* on its free end. The head 3*b* has a cross section having a V shape and gradually reduces in thickness toward its tip. The head 3*b* includes a first surface S1, a second surface S2 and a third surface S3 (exemplary end of a head). Each of the first, second and third surfaces S1, S2 and S3 may be coated with non-adhesive material in order to prevent the adhesive surface of the label continuous body P from easily sticking thereto even when the adhesive surface makes contact therewith.

The first surface S1 is an inner wall surface facing the paper container 6 (i.e., the outer periphery of the label continuous body P wound in a roll shape). For example, the first surface S1 has a curved shape along the outer periphery of the label continuous body P wound in a roll shape.

The second surface S2 is an inner wall surface configured to face the adhesive agent layer of a part unwound in a sheet shape from the label continuous body P when the unwound part is fed from the paper container 6 toward the platen roller 10. The second surface S2 is provided such that extension of the second surface S2 intersects with that of the first surface S1. The second surface S2 faces a paper path (feeding path) for a part unwound in a sheet shape from the label continuous body P. The second surface S2 has a flat shape along the part unwound in a sheet shape from the label continuous body P.

The third surface S3 corresponds to the tip of the head 3*b* of the opening and closing cover 3 (an end located in the vicinity of an intersecting line between extension of the first surface S1 and that of the second surface S2). The third surface S3 is part of an inner wall surface interposed between the first surface S1 and the second surface S2. The third surface S3 has, for instance, a flat shape. It should be noted that the shape of the third surface S3 is not limited to the flat shape and may be a curved shape.

As shown in FIGS. 2 to 4B, the aforementioned inner wall surfaces (the first, second and third surfaces S1, S2 and S3) of the opening and closing cover 3 are provided with ridges T. The ridges T are aligned at predetermined intervals along the axial direction (lengthwise direction) of the platen roller 10, and each ridge T (composed of first, second and third ridge parts T1, T2 and T3) continuously extends in the feeding direction of the label continuous body P.

The first ridge parts T1 are parts projecting from the first surface S1. The first ridge parts T1 herein provided can reduce the area that the label continuous body P wound in a roll shape makes contact with the first surface S1 when rotating within the paper container 6. Therefore, it is possible to reduce frictional resistance occurring in rotation of the label continuous body P wound in a roll shape.

The second ridge parts T2 are parts projecting from the second surface S2. The second ridge parts T2 herein provided can reduce the area that the adhesive agent layer of a part unwound in a sheet shape from the label continuous body P makes contact with the second surface S2. Therefore, the label continuous body P can be inhibited or prevented from sticking to the second surface S2.

The third ridge parts T3 are parts projecting from the third surface S3 composing the tip end of the head 3*b*. The third ridge parts T3 herein provided on the third surface S3 can reduce the area that the adhesive agent layer of the label continuous body P makes contact with the third surface S3. This is because a part of the third surface S3, configured to make contact with the adhesive agent layer of the label continuous body P, is limited to the third ridge T3. Accordingly, it is possible to reduce frictional resistance occurring in feeding a part unwound in a sheet shape from the label continuous body P during printing. Hence, the part unwound in a sheet shape from the label continuous body P can be fed without being adversely affected. Moreover, power for feeding the label continuous body P can be reduced. Hence, battery consumption can be reduced in the printer 1.

The third ridge parts T3 are constructed to have a longer projecting length (projecting height) than the first ridge parts T1 and the second ridge parts T2. With this construction, in feeding the label continuous body P during printing, the label continuous body P is configured to be supported at two contact points (two locations), composed of the third ridge parts T3 and the platen roller 10, in a range between the third surface S3 and the platen roller 10.

To prevent the adhesive surface of the label continuous body P from sticking to the second surface S2, it can be assumed to set the second ridge parts T2 on the second surface S2 to have the same projecting length as the third ridge parts T3. However, when the projecting length of the second ridge parts T2 is actually elongated, this increases a risk that the adhesive surface of the label continuous body P makes contact with part of the second ridge parts T2 on the second surface S2 in feeding the label continuous body P during printing. On the other hand, in back feeding of the label continuous body P, a part of the label continuous body P, located between the platen roller 10 and the third surface S3, sags and approaches to the second surface S2 as explained below with FIG. 10. Hence, when the projecting length of the second ridge parts T2 is set to have the same projecting length as the third ridge parts T3, the adhesive agent of the label continuous body P becomes likely to make contact with the second ridge parts T2 on the second surface S2. However, when the second surface S2 is not provided with the ridges T, increase in contact area is inevitable between the adhesive agent of the label continuous body P and the second surface S2. Based on the aforementioned perspectives, in the present exemplary embodiment, the second surface S2, composing part of the inner wall surfaces of the opening and closing cover 3, is provided with the second ridge parts T2 having a shorter projecting length than the third ridge parts T3 on the third surface S3 composing part of the inner wall surfaces of the opening and closing cover 3.

It should be noted that the shapes of the ridges T are not limited to the above. For example, the ridges T may be made in the shape of projected dots (scattered dots). In other words, a plurality of ridges T made in the shape of projected dots may be disposed on the inner wall surfaces (the first, second and third surfaces S1, S2 and S3) of the opening and closing cover 3. In this construction, the third ridge parts T3 on the third surface S3 are set to have a longer projecting length than the first ridge parts T1 on the first surface S1 and the second ridge parts T2 on the second surface S2.

As shown in FIGS. 2 and 3, sensors 12 (12*a*, 12*b*) are provided on the second surface S2 of the opening and closing cover 3. The sensor 12*a* is a sensor for detecting the locations of the labels (the aforementioned location detection marks) of the label continuous body P, for instance, and is composed of a reflective photosensor or so forth. On the other hand, the sensor 12*b* is a sensor for detecting whether or not the label continuous body P exists, for instance, and is composed of a transmissive photosensor or so forth. In the present exemplary embodiment, as described above, the label continuous body P is separated from the second surface S2 while being supported at two contact points composed of the platen roller 10 and the third ridge parts T3 on the third surface S3. Hence, a gap enough to detect the label continuous body P can be reliably produced between the sensors 12 and the label continuous body P. Consequently, the label continuous body P can be successfully detected by the sensors 12.

When labels with a mount are used as a label continuous body, the separation unit 4 exerts a function of separating labels from the mount of the label continuous body in separation ejection and then dividing the feeding path for the label continuous body into a feeding path for the mount and that for the labels. The separation unit 4 is mounted such that the lengthwise tip thereof can be moved to a normal ejection position located inside the printer 1 and the separation ejection position located outside the printer 1.

As shown in FIG. 5, the separation unit 4 includes a nip roller 4*a*, a shaft 4*b* for supporting the nip roller 4*a* in a rotatable state, a pair of support portions 4*c* for supporting the nip roller 4*a* and the shaft 4*b*, a pair of flat springs 4*da*, and screws 4*e* for fixing the flat springs 4*da*.

The nip roller 4*a* is a member configured to be disposed in opposition to the platen roller 10 in separation ejection and feed the mount inserted between the nip roller 4*a* and the platen roller 10 with the mount being pinched therebetween. The nip roller 4*a* is configured to be rotated in conjunction with rotation of the platen roller 10.

The pair of flat springs 4*da* is a pair of elastic structures configured to make contact with the unit holding portions 3*a* of the opening and closing cover 3 and urge the nip roller 4*a* toward the platen roller 10 when the opening and closing cover 3 is closed in performing separation ejection. Each flat spring 4*da* is fixed to one lengthwise end-side part (nip roller 4*a*-side part) of the outer lateral surface of each support portion 4*c*, extends therefrom in a curved shape to the other lengthwise end, and floats at its terminal end.

As shown in FIGS. 1A and 2, the front cover 5 is fixed to the body case 2 and covers a region opposed to the opening and closing cover 3 in the opening 2*a* of the body case 2 and parts of the body case 2 that are located in the vicinity of the both lateral surfaces of the body case 2. The front cover 5 is provided with a display 15, operating buttons 16*a* and 16*b*, an electric power button 17, a cover open button 18, a pair of release levers 19 and a cutter 20.

The display 15 is a screen for displaying an operating command, a message and so forth, and is composed of, for instance, an LCD (Liquid Crystal Display). The operating buttons 16*a* and 16*b* are buttons for operating the motion and setting of the printer 1, whereas the electric power button 17 is a button for turning on and off the electric power supply of the printer 1.

The cover open button 18 is a button for opening the opening and closing cover 3. The release levers 19 are members for holding the separation unit 4 in the normal ejection position. When the release levers 19 are moved to approach each other, the holding state of the separation unit 4 is configured to be releasable.

The cutter 20 is a member for cutting the label continuous body P for which normal ejection has been done. The cutter 20 is mounted to the tip of a part of the front cover 5, i.e., the tip of a part opposed to the opening and closing cover 3, while extending from end to end of the printer 1 in the axial direction of the platen roller 10. It should be noted that an ejection port is produced between the opening and closing cover 3 and the front cover 5.

Figure 6A:
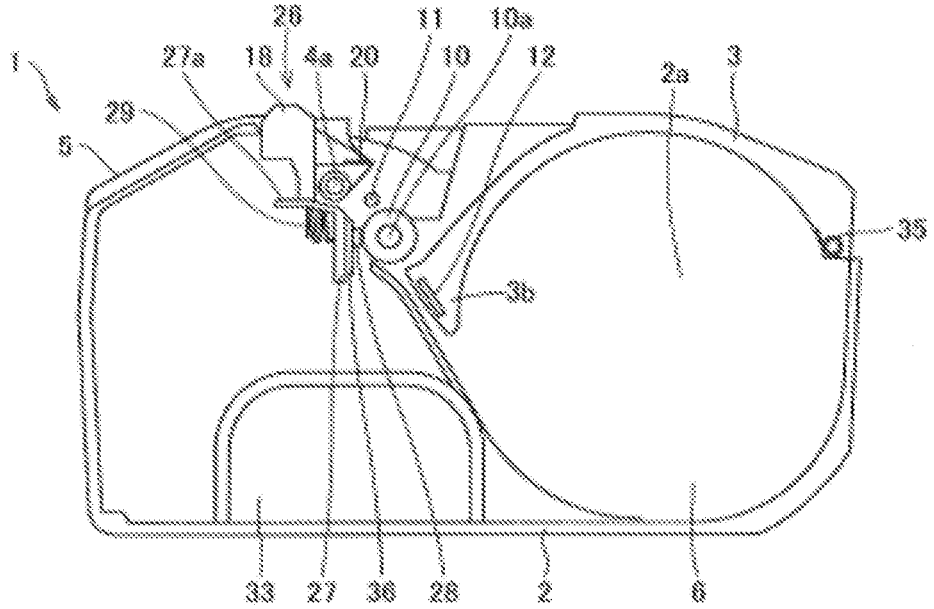
FIG. 6A is a schematic configuration diagram of the printer shown in FIG. 1A in performing normal ejection.
Figure 6B:
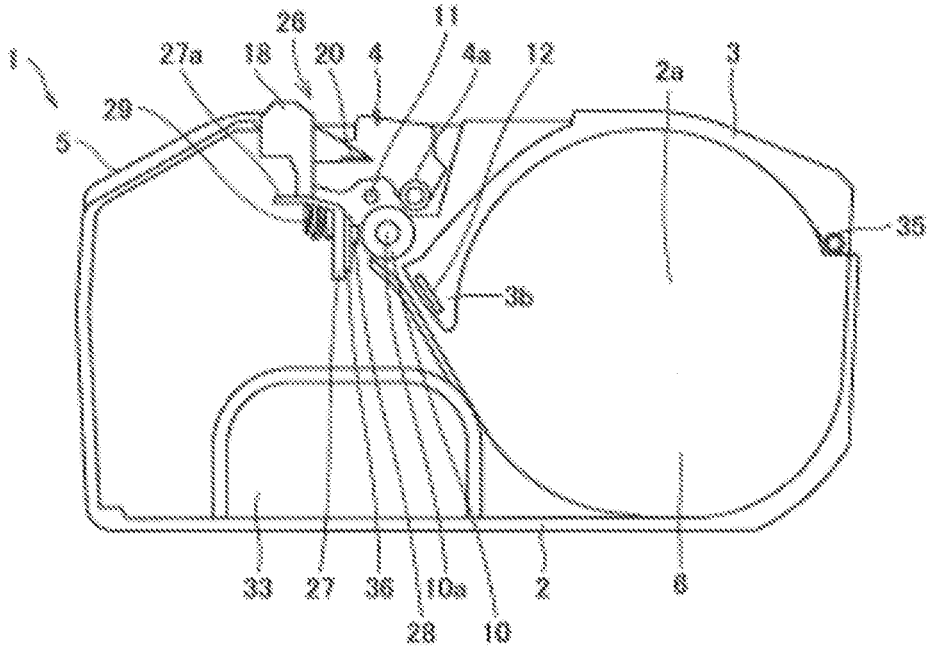
FIG. 6B is a schematic configuration diagram of the printer shown in FIG. 1B in performing separation ejection.

Next, the internal structure of the printer 1 will be explained with reference to FIGS. 6A and 6B. FIG. 6A is a schematic configuration diagram of the printer shown in FIG. 1A in performing normal ejection. FIG. 6B is a schematic configuration diagram of the printer shown in FIG. 1B in performing separation ejection.

As shown in FIGS. 6A and 6B, a printing body 26 is installed in the opening 2*a* of the body case 2 (the interior of the body case 2) while being located adjacently to the paper container 6. The printing body 26 is a functional part for performing printing on the label continuous body P. The printing body 26 includes a head bracket 27, a thermal head 28 (exemplary print head), a coil spring 29, the separation unit 4 and a battery container 33.

The head bracket 27 is a member for holding the opening and closing cover 3 set in the closed state. The head bracket 27 is installed while being configured to pivotably face the platen roller 10 when the opening and closing cover 3 is set in the closed state. When the platen roller shaft 10*a* of the platen roller 10 is fitted into a groove provided on the head bracket 27, the opening and closing cover 3 is configured to be held by the head bracket 27.

The head bracket 27 is integrally provided with a press part 27*a*. The press part 27*a* is disposed in a position (immediately below and) opposed to the cover open button 18. When the cover open button 18 is pressed, the press part 27*a* is also pressed and thereby the holding state of the opening and closing cover 3 by the head bracket 27 is configured to be released. When the holding state of the opening and closing cover 3 is herein released, the opening and closing cover 3 is configured to be automatically opened by an urging force of a torsion spring 35 disposed on the other lengthwise end thereof.

The thermal head 28 is printing means for printing information, for instance, a character, a sign, a diagram, a bar code or so forth on the label continuous body P. The thermal head 28 is mounted to the head bracket 27 through a circuit board 36 while a printing surface thereof faces the paper path. The thermal head 28 is configured to face the platen roller 10 when the opening and closing cover 3 is set in the closed state. A plurality of heating resistors (heating elements), configured to generate heat by electric conduction, are mounted to the printing surface of the thermal head 28 while being aligned along the width direction of the label continuous body P. It should be noted that the circuit board 36 is a wiring board configured to transmit a print signal to the thermal head 28.

The coil spring 29 is a member mounted to the back surface of the head bracket 27 (the back side of the surface to which the circuit board 36 is mounted). The coil spring 29 is configured to urge the head bracket 27 and the thermal head 28 toward the platen roller 10 when the opening and closing cover 3 is set in the closed state. The head bracket 27 is pressed toward the platen roller 10 by the urging force of the coil spring 29. Hence, the platen roller shaft 10*a*, fitted into the groove of the head bracket 27, is also pressed and thereby the holding state of the opening and closing cover 3 by the head bracket 27 is maintained.

The battery container 33 is a constituent element for accommodating a battery for driving the printer 1. The battery container 33 is configured to be opened and closed by the aforementioned battery cover 8 (see FIG. 2). It should be noted that a lithium-ion battery, for instance, is herein used as the battery.

Figure 7:
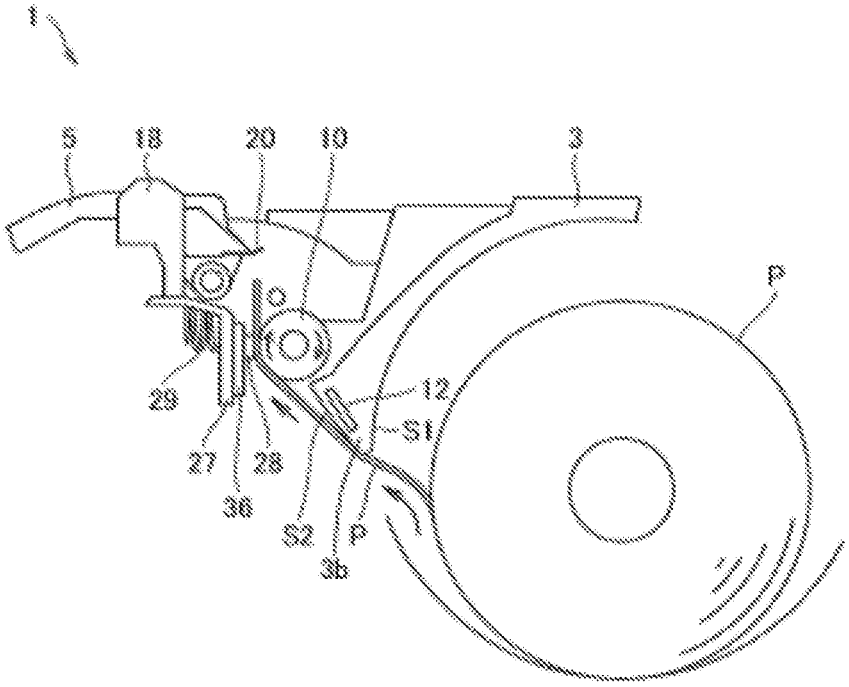
FIG. 7 is a schematic configuration diagram of the printer in a printing step.
Figure 8:
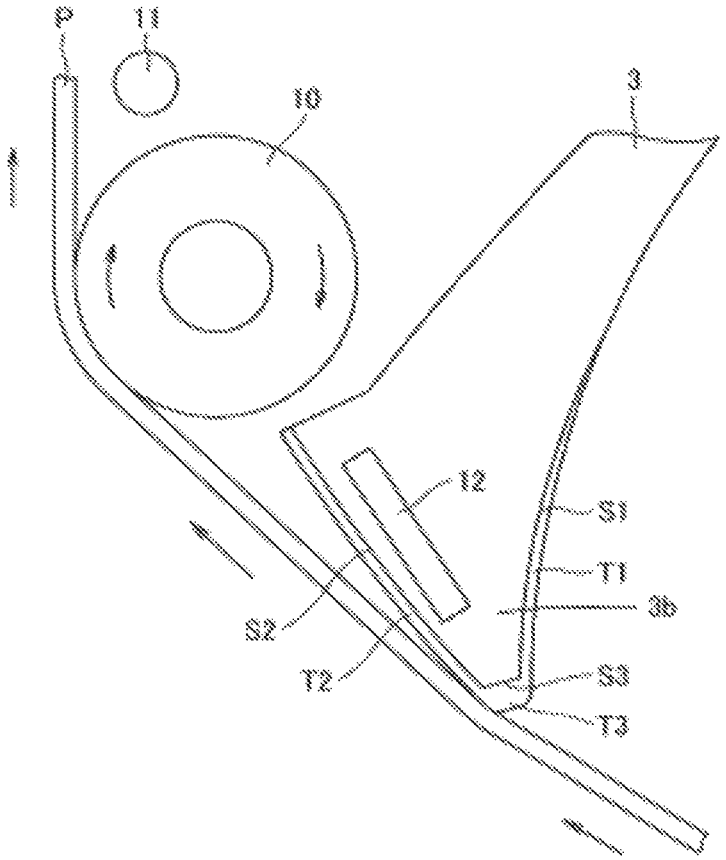
FIG. 8 is an enlarged schematic configuration diagram of major elements of the printer shown in FIG. 7.
Figure 9A:
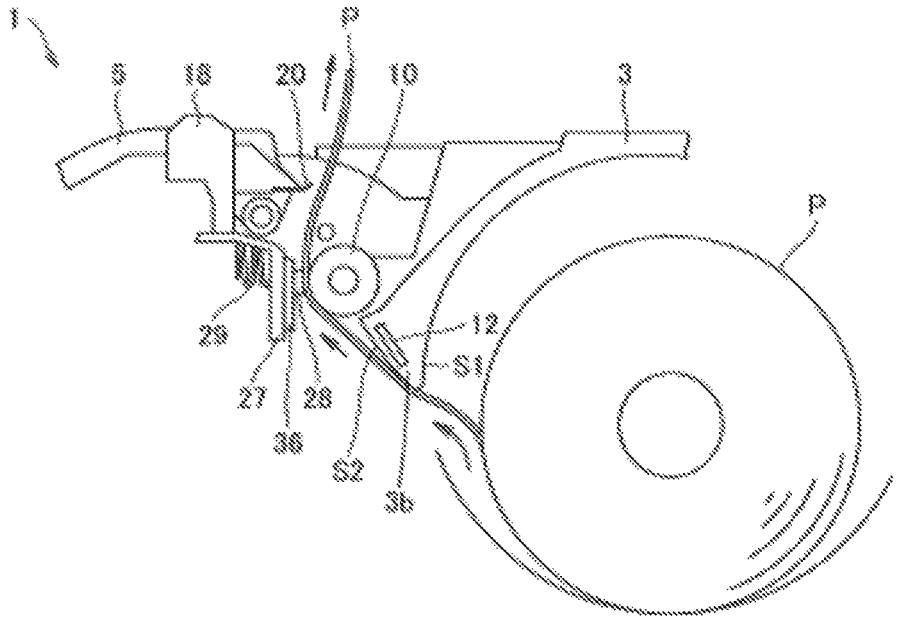
FIG. 9A is a schematic configuration diagram of the printer in another printing step subsequent to the printing step shown in FIG. 8.
Figure 9B:
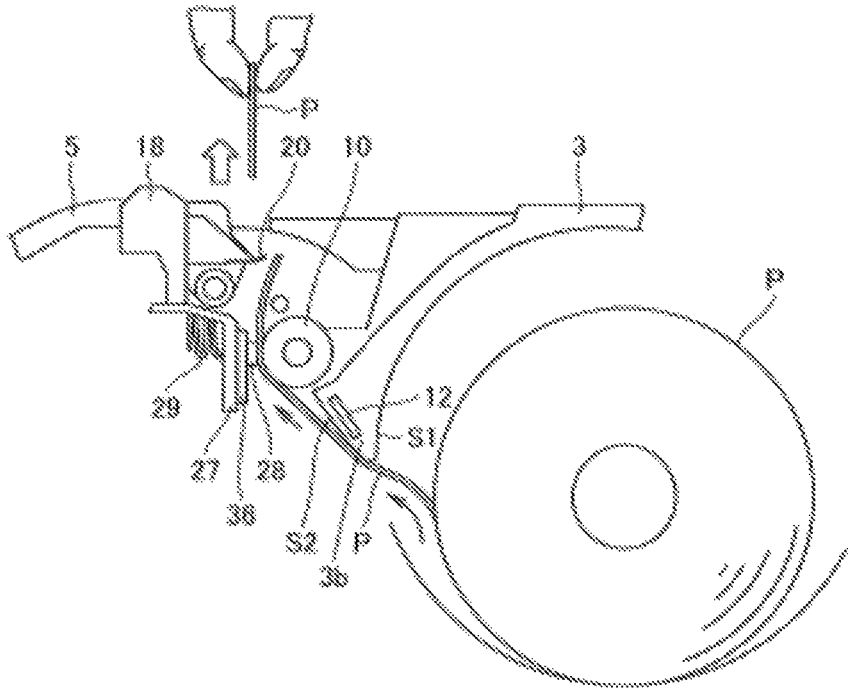
FIG. 9B is a schematic configuration diagram of the printer in yet another printing step subsequent to the printing step shown in FIG. 9A.
Figure 10:
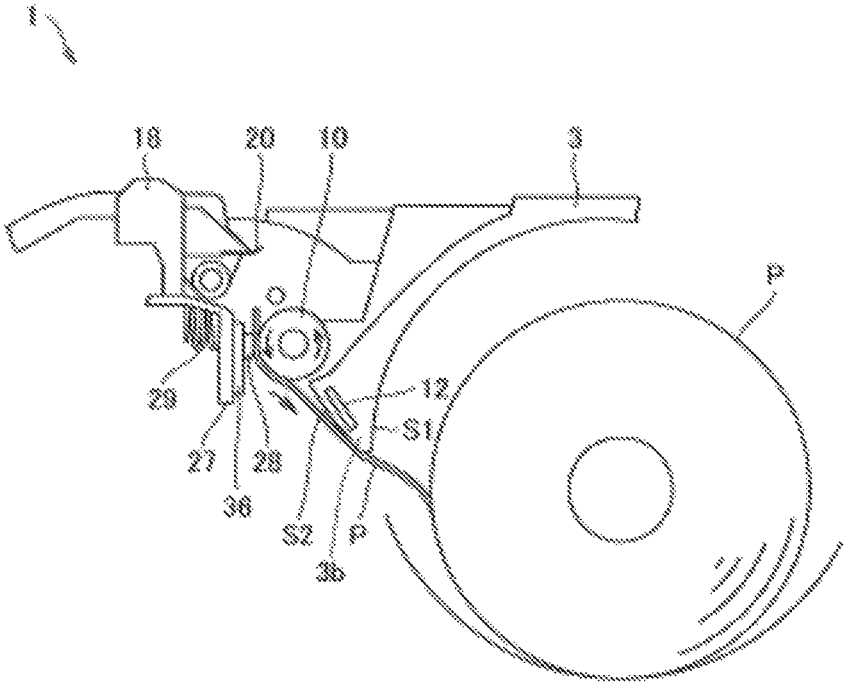
FIG. 10 is a schematic configuration diagram of the printer in a back feeding step.
Figure 11:
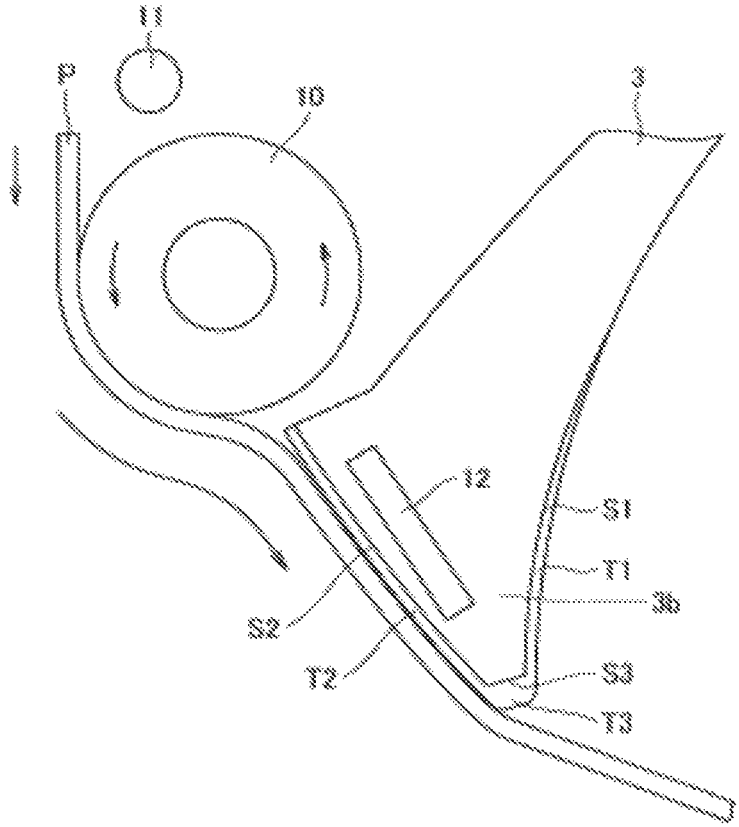
FIG. 11 is an enlarged schematic configuration diagram of major elements of the printer shown in FIG. 10.

Next, an exemplary method of printing by the printer 1 will be explained with reference to FIGS. 7 to 11. FIG. 7 is a schematic configuration diagram of the printer in a printing step. FIG. 8 is an enlarged schematic configuration diagram of major elements of the printer shown in FIG. 7. FIG. 9A is a schematic configuration diagram of the printer in another printing step subsequent to the printing step shown in FIG. 8. FIG. 9B is a schematic configuration diagram of the printer in yet another printing step subsequent to the printing step shown in FIG. 9A. FIG. 10 is a schematic configuration diagram of the printer in a back feeding step. FIG. 11 is an enlarged schematic configuration diagram of major elements of the printer shown in FIG. 10.

As shown in FIGS. 7 and 8, in the printing step, the label continuous body P is configured to be fed by rotating the platen roller 10 while a part of the label continuous body P, unwound in a sheet shape from the paper container 6, is pinched between the thermal head 28 and the platen roller 10. While the label continuous body P is being fed during printing, intended information is configured to be printed on the thermal labels of the label continuous body P at printing timing, set based on a timing signal detected by the sensors 12, by causing the heating resistors of the thermal head 28 to perform heating and scanning in response to a print signal transmitted to the thermal head 28. It should be noted that in the printing step, the separation unit 4 is configured to be disposed (below the cutter 20) in the interior of the printer 1.

In the present exemplary embodiment, the third ridge parts T3 are provided on the third surface S3 of the opening and closing cover 3. Hence, in this printing step, it is possible to reduce the area that the adhesive agent layer of a part unwound in a sheet shape from the label continuous body P makes contact with the third surface S3. Accordingly, it is possible to reduce frictional resistance occurring in feeding the part unwound in a sheet shape from the label continuous body P during printing. Hence, the part unwound in a sheet shape from the label continuous body P can be fed without being adversely affected. Moreover, power for feeding the label continuous body P can be reduced. Hence, battery consumption can be reduced in the printer 1.

Additionally, the third ridge parts T3 are constructed to have a longer (higher) projecting length (projecting height) than the first ridge parts T1 and the second ridge parts T2. Hence, in feeding the label continuous body P during printing, the label continuous body P is configured to be supported at two contact points (two locations), composed of the third ridge parts T3 and the platen roller 10, in a range between the third surface S3 and the platen roller 10. Moreover, the label continuous body P is separated from the second surface S2 while being supported at two contact points (two locations) composed of the platen roller 10 and the third ridge parts T3. Hence, a gap enough to detect the label continuous body P can be reliably produced between the sensors 12 and the label continuous body P. Therefore, a variety of information can be successfully detected by the sensors 12, including the location detection marks on the label continuous body P, whether or not the label continuous body P exists, and so forth.

Furthermore, in the present exemplary embodiment, among the ridges T, the second ridge parts T2 on the second surface S2 are constructed to have a shorter projecting length than the third ridge parts T3 on the third surface S3. Hence, this reduces a risk that the label continuous body P makes contact with the second ridge parts T2 in feeding the label continuous body P during printing. Even when the label continuous body P makes contact with the second ridge parts T2, the contact area can be limited to be a small area. With this construction, smooth feeding is enabled for the label continuous body P. In other words, performance of feeding the label continuous body P can be enhanced.

Next, as shown in FIG. 9A, a printed label part of the label continuous body P is ejected. Thereafter, as shown in FIG. 9B, the printed label part is cut off with the edge of the cutter 20, while being pinched by fingers. Next, as shown in FIGS. 10 and 11, back feeding is performed for the label continuous body P. A leading label part of the label continuous body P, located next to the cut-off printed label part, is returned to the printing position (the thermal head 28 side). In this case, in feeding the label continuous body P in the back feeding direction, a part of the label continuous body P, located between the platen roller 10 and the third surface S3, sags and approaches to the second surface S2. Hence, when the projecting length of the second ridge parts T2 is similarly long to that of the third ridge parts T3, the adhesive agent of the part of the label continuous body P becomes likely to make contact with the second ridge parts T2. By contrast, in the present exemplary embodiment, the second ridge parts T2 have a shorter (lower) projecting length than the third ridge parts T3. Hence, even in back feeding, the adhesive agent layer of the part of the label continuous body P is unlikely to make contact with the second ridge parts T2.

Even when the adhesive agent layer of the part of the label continuous body P makes contact with the second ridge parts T2, the contact area is small and therefore the adhesive agent layer is prevented from sticking to the second ridge parts T2. Consequently, performance of feeding the label continuous body P can be also enhanced in back feeding.

Based on the exemplary embodiment, the present invention made by the inventor of the present application has been specifically explained above. The exemplary embodiment disclosed in the present specification is exemplary only in all aspects and the present invention is not limited to the technology herein disclosed. In other words, the technical scope of the present invention should not be interpreted restrictively based on the explanation in the aforementioned detailed description, rather should be interpreted based on the description of claims, and encompasses equivalents of the technology described in the claims and all the changes made without departing from the gist of the claims.

For example, the aforementioned exemplary embodiment has explained that the present invention is applied to a dual mode printer usable for both of normal ejection and separation ejection. However, the application of the present invention is not limited to this, and is applicable to a printer usable exclusively for normal ejection.

Additionally, the aforementioned exemplary embodiment has explained that a label continuous body including an adhesive agent layer on one surface (mountless labels) is used as a print medium. However, the print medium is not limited to this. For example, a label continuous body in which a plurality of labels are temporarily attached to a long strip of mount (labels with a mount) or a continuously produced sheet without any adhesive agent layer (continuous sheet) is usable as the print medium, and not only a paper medium but also a film printable by a thermal head or so forth is usable as the print medium. The labels with a mount, the continuous sheet or the film can be provided with location detection marks.

The invention claimed is:

1. A printer, comprising:

a housing provided with an opening;

a print medium container built in the opening of the housing, the print medium container being capable of containing a print medium, the print medium including an adhesive agent layer on one surface thereof;

an opening and closing cover configured to open and close the print medium container with respect to the housing;

a feed roller configured to feed the print medium; and a print head mounted opposing the feed roller, the print head being configured to perform printing on the print medium, wherein the opening and closing cover is provided with a head on a free end thereof, the head gradually reducing in thickness toward a tip thereof, wherein the head includes:

a first surface configured to face the print medium container when the opening and closing cover is set in a closed state;

a second surface configured to face the adhesive agent layer of the print medium when the print medium is fed from the print medium container toward the feed roller, the second surface provided with a ridge part projecting therefrom; and an end surface disposed at a tip of the opening and closing cover and configured to face a feeding path of the print medium, the feeding path located between the print medium container and the feed roller, the end surface provided with a ridge part for projecting therefrom toward the adhesive agent layer of the print medium, and wherein the ridge part projecting from the end surface has a longer projecting length than the ridge part projecting from the second surface.

2. The printer according to claim 1, wherein the end surface is a surface defined by an end of the first surface and an end of the second surface, the end of the first surface being located on a side of the free end of the opening and closing cover, the end of the second surface being located on a side of the free end of the opening and closing cover.

3. The printer according to claim 1, wherein the ridge part projecting from the end surface and the ridge part projecting from the second surface continuously extend in a feeding direction of the print medium.

4. The printer according to claim 1, wherein at least one of the end surface, the first surface, and the second surface is coated with a non-adhesive material.

5. The printer according to claim 1, wherein the first surface of the head is provided with a ridge part having a shorter projecting length than the ridge part projecting from the end surface.

* * * * *